US006236155B1

(12) United States Patent
Rossi

(10) Patent No.: US 6,236,155 B1
(45) Date of Patent: May 22, 2001

(54) HIGH CHROMIUM SECOND ANODE BUTTON FOR CATHODE RAY TUBE

(75) Inventor: Juan J. Rossi, York, PA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/323,816

(22) Filed: Jun. 2, 1999

Related U.S. Application Data

(60) Provisional application No. 60/128,977, filed on Apr. 12, 1999.

(51) Int. Cl.[7] ..... H01J 31/00

(52) U.S. Cl. ..... 313/477 R; 313/477 HC; 313/479

(58) Field of Search ..... 313/477 HC, 477 R, 313/479

(56) References Cited

U.S. PATENT DOCUMENTS

| | | | | |
|---|---|---|---|---|
| 3,666,343 | | 5/1972 | McNeill | 316/20 |
| 4,155,614 | * | 5/1979 | Hall | 313/331 |
| 4,406,637 | * | 9/1983 | Hernqvist | 445/45 |
| 5,081,393 | * | 1/1992 | Kinami | 313/412 |
| 6,048,644 | * | 4/2000 | Tsuji et al. | 429/218.2 |
| 6,104,136 | * | 8/2000 | Abe et al. | 313/495 |

* cited by examiner

*Primary Examiner*—Vip Patel
*Assistant Examiner*—Ken A Berck
(74) *Attorney, Agent, or Firm*—William H. McNeill

(57) ABSTRACT

A second anode button for a cathode ray tube comprises a ferritic stainless steel alloy having a chromium content of about 10 to about 20% by weight and that is nickel-free.

4 Claims, 1 Drawing Sheet

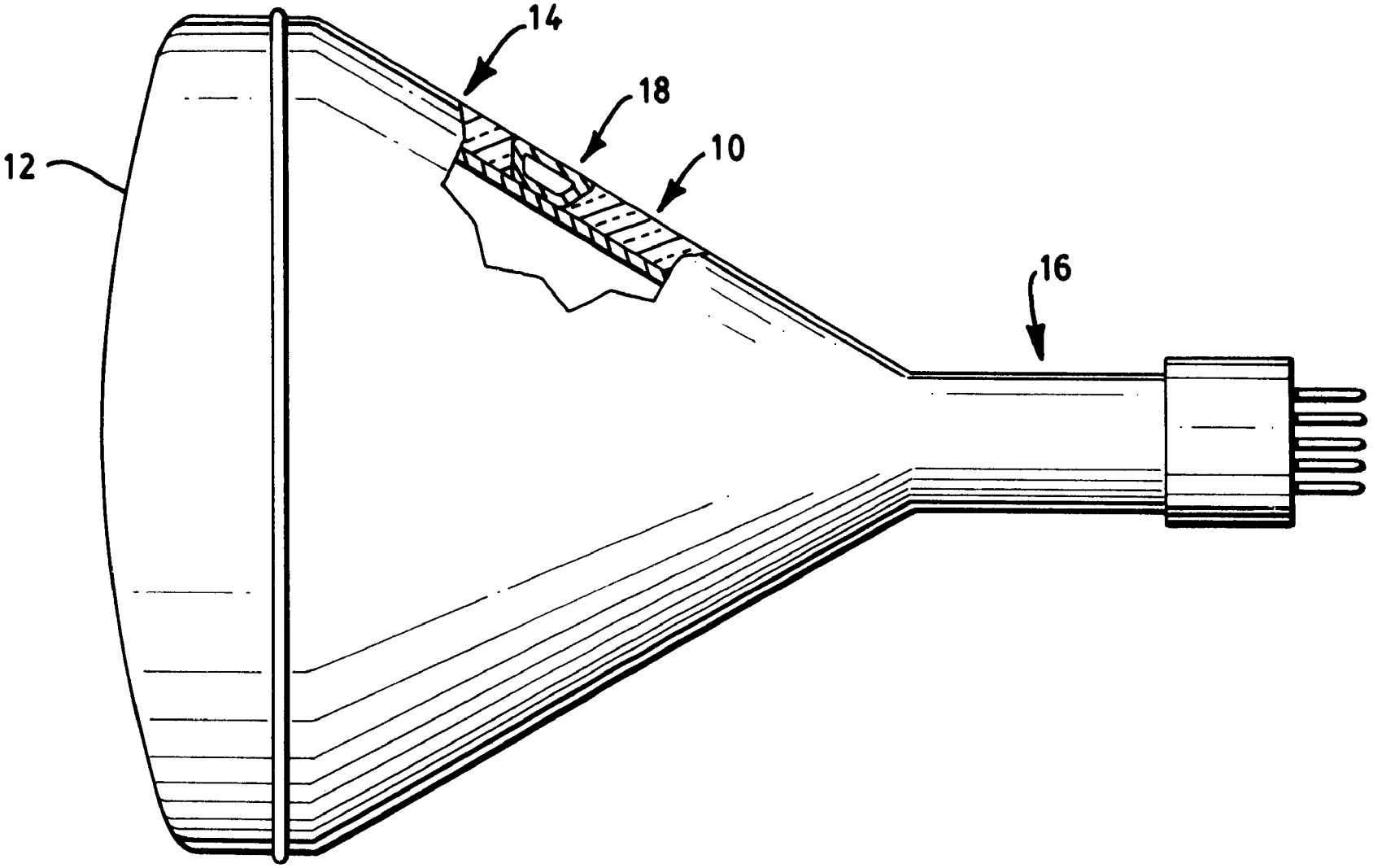
16
10
18
14
12

HIGH CHROMIUM SECOND ANODE BUTTON FOR CATHODE RAY TUBE

This application claims priority from Provisional Application Ser. No. 60/128,977, filed Apr. 12, 1999.

TECHNICAL FIELD

This invention relates to glass-to-metal sealing and particularly to metallic second anode buttons sealed into the glass funnels of cathode ray tubes.

BACKGROUND ART

Cathode ray tubes require numerous electrical potentials to be applied to the electrodes of the tube. One of these, the second anode has a very high potential, in the order of 30 kV or more in the case of color picture tubes, applied thereto. This potential is conventionally applied through the funnel by a connector hermetically sealed therein. This connector is conventionally called a second anode button. It is a substantially hollow, electrically conductive button having a thermal coefficient of expansion that substantially matches that of the glass into which it is sealed. Prior to insertion the button is oxidized so that an oxide to oxide bond is formed with the glass.

Prior buttons have been made from a 42%Ni-6%Cr iron alloy (ASTM F31) and more recently from a 47%Ni-6%Cr iron alloy (known commercially as N485). Other iron-based alloys that have been used for glass-to-metal seals include chromium-free nickel alloys (ASTM F30) and 18 to 26% chromium-iron alloys; however, neither of the latter two are known to have been used for anode buttons.

The thermal expansion-contraction differences between glass and metal generate the mismatch stresses that account for much of the breakage that takes place during heat cycles at fabrication. Examination of volume-temperature diagrams for the typical lead or soda-lime glasses used for the funnels show that they exhibit a non-linear behavior that can be matched to the volume-temperature curves of nickel-iron alloys in the 40 to 50% nickel range. However, due to their nickel content, these alloys are significantly more expensive than nickel-free alloys.

DISCLOSURE OF INVENTION

It is, therefore, an object of the invention to obviate the disadvantages of the prior art.

It is another object of the invention to enhance the glass-to-metal sealing of second anode buttons.

It is another object of the invention to reduce the cost of second anode buttons.

These objects are accomplished, in one aspect of the invention, by a second anode button for a cathode ray tube comprising a ferritic stainless steel alloy having a chromium content of about 10 to about 20% by weight.

This button matches the thermal coefficients of expansion of the funnel glass and is less costly than those of the prior art. It oxidizes well to form tight, hermetic seals the funnel glass, thereby enhancing the cathode ray tubes with which it is employed.

BRIEF DESCRIPTION OF THE DRAWINGS

The single FIGURE is a side elevational view of a cathode ray tube, partially in section, illustrating an embodiment of the invention.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Referring now to the drawing with greater particularity, there is shown a cathode ray tube 10 of a type that can be employed in color television receivers or as a computer monitor. The tube 10 has a face 12 upon which the display is presented and a funnel body 14 that is connected thereto and terminates in a neck 16. A second anode button 18 is hermetically sealed into the funnel 14. In accordance with an aspect of the invention, the button 18 is constructed of a high chromium stainless steel, for example, a nickel-free stainless steel containing from about 10 to about 20% by weight chromium.

These alloys have thermal coefficients of expansion in the range of 11 to 12.5 ppm°C. over the range of 30 to 530° C., and are a good match for the funnel glasses being used today.

These buttons are extremely workable and lend themselves to either one piece or two piece construction, with or without additional X-ray protection. Such buttons are shown, for example, in U.S. Pat. No. 3,666,343.

Thus there are here provided second anode buttons that are economical to employ and seal well to funnel glass.

While there have been shown and described what are at present considered the preferred embodiments of the invention, it will be apparent to those skilled in the art that various changes and modifications can be made herein without departing from the scope of the invention as defined by the appended claims.

What is claimed is:

1. A second anode button for a cathode ray tube comprising: a ferritic stainless steel alloy having a chromium content of about 10 to about 20% by weight.

2. A glass funnel for a cathode ray tube having hermetically sealed therein a second anode button, said second anode button having a composition of 10 to 28% by weight chromium and the balance iron.

3. The funnel of claim 2 wherein said hermetic seal is achieved by an oxide to oxide bond between said glass and said button.

4. The second anode button of claim 1 wherein said button is nickel-free.

* * * * *